United States Patent [19]

Cans et al.

[11] Patent Number: 4,781,239

[45] Date of Patent: Nov. 1, 1988

[54] PROCESS AND APPARATUS FOR CASTING IN A PIT, WITHOUT ANY EXPLOSIVE RISK, OF ALUMINUM AND ITS ALLOYS, PARTICULARLY WITH LITHIUM

[75] Inventors: Yves Cans, Saint Egréve; Jean-Marie Hicter; Jacques Moriceau, both of Coublevie, all of France

[73] Assignee: Cegedur Societe de Transformation de L'Aluminium Pechiney, Paris, France

[21] Appl. No.: 122,180

[22] Filed: Nov. 18, 1987

[30] Foreign Application Priority Data

Dec. 3, 1986 [FR] France ..... 86 17770

[51] Int. Cl.[4] ..... B22D 11/124

[52] U.S. Cl. ..... 164/486; 164/444

[58] Field of Search ..... 164/5, 443, 444, 485, 164/486, 487

[56] References Cited

U.S. PATENT DOCUMENTS

| | | | |
|---|---|---|---|
| 3,512,574 | 5/1970 | Taylor | 164/487 |
| 3,653,425 | 4/1972 | Elliott et al. | 164/487 |
| 3,891,024 | 6/1975 | Gervais et al. | 164/487 |
| 4,509,582 | 4/1985 | Kriegner | 164/486 |
| 4,651,804 | 3/1987 | Grimes et al. | 164/487 |

FOREIGN PATENT DOCUMENTS

| | | | |
|---|---|---|---|
| 520176 | 8/1976 | U.S.S.R. | 164/444 |
| 2077643 | 12/1981 | United Kingdom | 164/485 |

*Primary Examiner*—Nicholas P. Godici
*Assistant Examiner*—Richard K. Seidel
*Attorney, Agent, or Firm*—Dennison, Meserole, Pollack & Scheiner

[57] ABSTRACT

The invention relates to a process and an apparatus for casting in a pit, without risk of explosion, of aluminum and its alloys, particularly with lithium.

It comprises placing an elastic shield (3) around the cast product in order to stop the cooling water and any liquid metal outpouring, the water and metal being collected by flowing over the shield, into inclined channels (5 to 14), where the water forms a film and the metal is stopped in portionwise manner by strips (19) located at appropriate distances within the channels.

7 Claims, 1 Drawing Sheet

Figure 1:
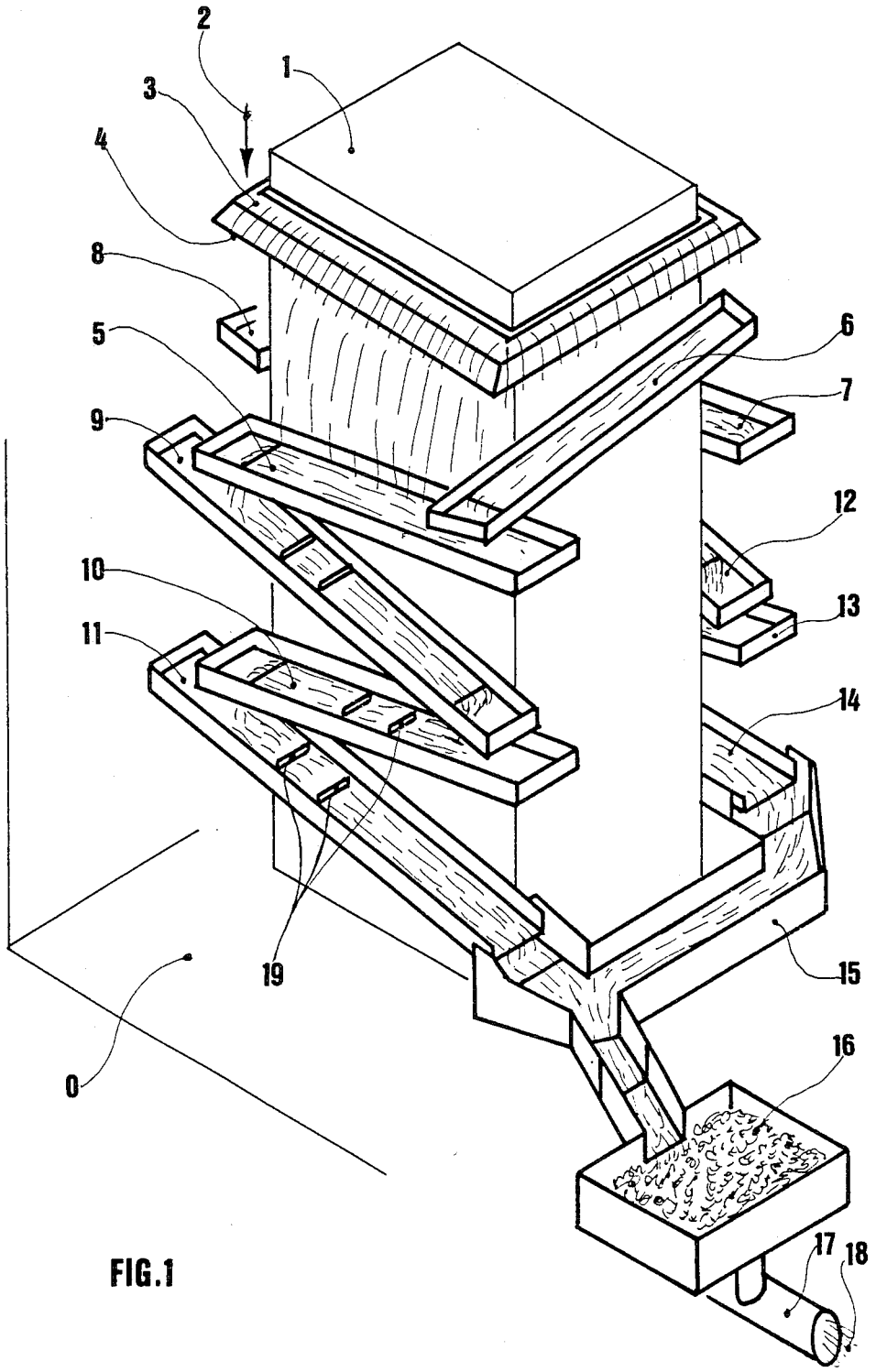

PROCESS AND APPARATUS FOR CASTING IN A PIT, WITHOUT ANY EXPLOSIVE RISK, OF ALUMINUM AND ITS ALLOYS, PARTICULARLY WITH LITHIUM

The invention relates to a process and apparatus for casting in a pit, without any explosion risk, of aluminium and its alloys, particularly with lithium.

The foundry Expert is well acquainted with the process of semi-continuous vertical casting, in which the molten metal is poured into an ingot mould having a cooled mobile bottom, where it partly solidifies and is then drawn continuously towards the bottom in the form of plates or billets, onto which is sprayed water in order to speed up the cooling thereof. The casting apparatuses used for applying this process are generally placed flush with the floor above the relatively deep pits for receiving both the cast product, the cooling water which is discharged to a sewer or drain and optionally any metal which may have run out possibly due to the accidental fracture of the skin of the cast product.

The Expert also knows that liquid aluminium can, under certain conditions, react violently with the water and lead to powerful explosions, which are dangerous for staff and equipment located in the vicinity thereof. However, these conditions may occur when performing the vertical casting process, particularly when metal which has run out drops into the stagnant water at the bottom of the pit.

This is why research has been undertaken over the past few decades with the aim of preventing such explosions. Thus, in an article which appeared in the journal Metal Progress, May 1957 and entitled "Explosions of molten aluminium in watercourses and prevention", G. LANG recommends the painting or greasing of the bottom of the pit and, if possible, keeping a relatively high water level therein. It is on the basis of these conclusions that in most aluminium foundries rules have been drawn up and which can be summarized as follows:

a height of water of at least 1 meter must be maintained in the pit, the level of the water within the pit must be at least 3.30 m below the ingot mould, any casting installation and the walls of the pit must be clean, free from rust and coated with an appropriate organic material.

The application of these rules has certainly made it possible to reduce to a very low level the risks of explosions in foundries, at least with regards to the casting of conventional alloys.

However, for some years there has been an interest, particularly in the aeronautical industry, in aluminium-lithium alloys and foundry Experts have been confronted once again with the problem of explosions risks. Thus, as was stated by G. LANG in the aforementioned article whilst referring to H.M. HIGGINS, when molten aluminium-lithium is dispersed in water in any way, there can be a violent explosion, which is not the case with aluminium.

Therefore it was no longer a question of just sticking to the rules given hereinbefore when casting this new type of alloy. However, solutions rapidly appeared. Thus, in European Patent No. 142 341, the cooling water is replaced by an organic fluid and more particularly by ethylene glycol. It certainly provides a solution offering improved safety conditions, because water, which is the essential cause of explosions, is excluded from the process. However, it is relatively expensive, because it requires a recycling of the fluid and also organic fluids offer less possibilities than water with respect to the transfer coefficient and thermal behaviour.

Another solution is given in European Patent No. 150 922 which, according to the main claim, comprises starting casting with an empty pit and removing the cooling water from the pit in a continuous manner and at an adequate speed to ensure that no pool is produced in the pit. This solution suffers from the disadvantage of requiring a pumping installation with possible failure if a liquid metal quantity drops into the pit.

Thus, not wishing to lose the interest offered by water as a cooling liquid or wishing to use pumps, the Applicant has developed a new process ensuring that there are no explosion risks during casting, particularly in the form of plates, of alloys containing highly oxidizable elements and in particular lithium.

This process is based on the use of shields or screens, as described in U.S. Pat. No. 3,653,425 and which in the case of highly alloyed plates or billets, serve to remove the cooling liquid from the solidified surfaces of the metal soon after it has been sprayed onto the product leaving the ingot mould, in order to enable the metal which is at a high temperature in the centre of the product to reheat the cooler metal at the surface and to eliminate tensions, thus preventing or minimizing the formation of cracks.

However, in the above patent, the water and possibly the metal outflows are stopped by the shields and drop by gravity into the pit, whereas in the process of the invention, it is a question of collecting at the shield and over its entire peripherary both the water in the form of a film and any outpouring of liquid metal, whereby they are made to flow by gravity along an inclined plane, the metal is separated from the water in portionwise manner and the water is recovered outside the pit.

Thus, through collecting the water level with the shield and over its entire peripherary and recovering it outside the pit prevents any flow of water towards the bottom of the latter. It is therefore possible to work with virtually a dry pit and prevent any risk of explosion, without having to have recourse to pumps during casting.

By placing the shield at a distance below the ingot mould, corresponding to the maximum depth of the liquid pool, it is certain that the outpouring of liquid metal can only occur above the shield. Moreover, to prevent at the time of starting any outpouring of liquid metal below the shield, it is advantageously possible to add a reliable extraction device for the product on starting.

The simultaneous collecting of water and liquid metal could give rise to the idea that the risk of explosion has been transferred from the pit to the main, but this is not so, because it has been found that by collecting the water in the form of a sheet of limited thickness flowing by gravity at an appropriate speed and by progressively separating the metal by fractions, there is no violent reaction liable to cause physical and/or material damage. Thus, it is possible to prevent any fine dispersion of the metal in the water, which is the cause of explosions.

The most satisfactory results were obtained with films of water having a thickness less than 10 mm and means making it possible to break up the metal flow into unitary quantities weighing less than 10 kg.

Preferably, before discharging the water into the sewers, it is passed over a filter, e.g. constituted by aluminium balls, so as to remove all final traces of metal particles therefrom.

The invention also relates to a special apparatus making it possible to perform the above process. This apparatus, which consequently comprises an elastic shield faithfully matching the contour of the cast product, is characterized in that the peripherary of the shield overhangs a group of inclined channels, whereof the ends are superimposed so as to deliver the water from one to the other in the form of a cascade, the downstream channels being equipped with small bars or strips placed perpendicularly to the flow direction of the liquids, the lower channel overhanging a lined filter.

Thus, said apparatus is constituted by a group of channels, i.e. metal ducts open at the top over their entire length, which have a flat bottom and inclined at a gradient between 4 and 12%. These channels have an adequate height to be able to accept the maximum quantity of liquid metal which can be spilled during an incident. Their width and gradient are calculated in such a way that under the maximum cooling conditions, the necessary water volume forms a film with a thickness less than 10 mm. The channels placed downstream of the cascade are internally lined with small bars or strips forming a barrier to the flow of part of the metal. The distance separating these strips and their height is a function of the total metal quantity liable to flow and the fact that each strip does not have to hold back more than 10 kg of metal.

The upstream channels and which are the channels directly receiving the water overflowing the shield, are smooth in order to give the liquid metal discharged as a result of a skin fracture an initial outflow speed adequate for preventing any accumulation. These channels are disposed in the space with respect to the shield and the cast plate in the following way:

immediately below the shield, four smooth channels, extending parallel to the four faces of the plate and at a distance such that they can collect all the cooling water and the liquid metal overflowing the shield, the two channels facing the small faces discharging their content into those facing the large faces;

below these four channels, two series of channels with strips exclusively extending in front of the large faces of the plate, whereby in each of these series, the channels discharge into one another in cascade form, the upper channel receiving the content of the corresponding smooth channel.

All these channels are either superimposed and then have a reverse slope compared with their neighbours, or constitute extensions of one another as a function of the type of pit used and which will be described hereinafter.

The lower channels of each series are combined into a common channel to discharge their content into a filter. This filter is constituted by a pocket, which is preferably lined with aluminium balls on which are deposited the metal fines, which might have escaped from the barriers.

The shield has no special features compared with those used in the prior art. However, preference is given to shields fixed to cooled frames and formed from two elastic sheets between which can be passed a gas stream, thus making it possible to vaporize any trace of water which might have infiltrated between the plate and the first sheet.

Although such an apparatus is applicable to conventional pits having four vertical walls where, as a result of the space problem which occurs, the channels are superimposed. However this apparatus can be supplemented by the use of a pit with three vertical walls and a fourth wall in inclined plane open towards the outside of the casting area and in this case the channels are extensions of one another. Such a pit has numerous advantages from the safety standpoint compared with a pit having four vertical walls in the case of casting incidents. Thus, it makes it possible to increase the natural ventilation of the pit and to speed up the elimination of hydrogen which might be emitted during an outflow of liquid metal.

The invention will be better understood from the attached drawing, which is a perspective view of an apparatus according to the invention in the case where the pit has four vertical walls. In a pit O, there is a plate 1 on which the water trickles which circulates in the direction of arrow 2, whilst passing in contact with shield 3, whose edge 4 overhangs the four smooth channels 5, 6, 7 and 8, which collect the water and optionally the liquid metal which has poured out and in the case of 5 and 6 pass the same into channel 9 of the series with strips 9, 10 and 11 and for 7 and 8 into channel 12 of the series with strips 12, 13 and 14. Channels 11 and 14 are combined in the common channel 15, which discharges its content into a filter 16, from where the water 18 free from any solids is discharged into the sewer or drain 17. It is possible to see in channels 9, 10 and 11, strips 19 for holding back the metal in fractionated manner.

The invention can be illustrated with the aid of the following example. In a casting installation for an aluminium alloy containing 3% by weight of lithium in the form of 1100×300 mm plates, directly cooled with a water flow of 20 $m^3/h$, a 1500 mm wide and 700 mm thick rubber shield has been horizontally placed around the plate at a distance of 150 mm from the bottom of the ingot mould.

Sheet steel channels 1700 mm long for the large sides and 1000 mm long for the small sides of the plate, with a height of 100 mm and a width of 500 mm, being inclined by four degrees have been positioned, in the manner described hereinbefore, at a distance, measured in their centre, of 300 mm from the screen and 250 mm from one another. 15 mm high small bars or strips, spaced from one another by 340 mm have been placed across three downstream channels, each constituting series.

The water leaving the common channel is directed towards a 1000×500×500 mm filter, lined over a height of 200 mm with aluminium balls having a diameter of 10 mm and connected to a drain.

An outpouring of 100 kg of liquid metal was brought about one one of the large faces of the plate. The metal was held back in portions of 8 to 10 kg at each barrier and stopped flowing at the end of the second channel of the series placed facing the perforated face. Fines were transferred in a quantity of approximately 15 kg into the filter.

This operation was repeated several times and it was found that it was always accompanied by plumes of smoke and water vapour, but that no explosion occurred.

It is obvious that such an invention can be applied to the casting of billets, provided that the shape of the channel is adapted to that of the cast product and that in this case said channel can be continuous and has no slope or gradient inversion.

We claim:

1. In a process for casting in a pit without any risk of explosion, aluminum and its alloys by casting in a cooled ingot mould with a mobile bottom, which is vertically axed and is supplied in its upper part with liquid metal and from which continuously flows through a lower part a partly solidified metal, comprising accelerating cooling by spraying the cast metal with water, and permitting the sprayed water to trickle on the surface of the metal to a level where it is separated from the metal surface by an elastic shield, the improvement comprising collecting at the level of the shield and over the entire periphery of the shield, the cooling water in the form of a film and any liquid metal outpouring from the shield, causing the water and metal to flow downwardly by gravity along an inclined plane, separating the metal from the water in portionwise manner and recovering the water outside the pit.

2. Process according to claim 1, wherein the thickness of the film of water is below 10 mm.

3. Process according to claim 1, wherein the water and the metal are separated, while holding back the metal in fractions or portions weighing less than 10 kg.

4. Process according to claim 1, wherein the water is filtered before being recovered.

5. In an apparatus for casting aluminum and its alloys in a pit without risk of explosion, comprising a cooled ingot mold with a mobile bottom, which is vertically axed and adapted to be supplied in its upper part with a liquid metal which partly solidifies and flows from its lower part, means for spraying cooling water on the metal, and an elastic shield (5) faithfully adapting to the contour of the cast product (1) and which separates the cooling water from the surface of the metal, the improvement comprising a plurality of inclined channels (5 to 14) overhung by the periphery of the shield, the ends of said channels being superimposed so as to deliver the water from one channel to another in cascade form, the downstream positioned channels being equipped with strips (19) positioned perpendicularly to the liquid outflow direction, and a lined filter (16) overhung by the lowermost channel.

6. Apparatus according to claim 5, characterized in that the channels are inclined with a gradient between 4 and 12%.

7. Apparatus according to claim 5, additionally comprising a pit in which said casting apparatus is located, said pit having three vertical walls and a fourth wall in an inclined plane open toward the outside of the area in which casting takes place.

* * * * *